US009594348B2

(12) United States Patent
Denden et al.

(10) Patent No.: US 9,594,348 B2
(45) Date of Patent: Mar. 14, 2017

(54) DEVICE FOR THE DISPLAY OF PERIODS FORMING AN ANNUAL CYCLE

(71) Applicant: Blancpain S.A., Le Brassus (CH)

(72) Inventors: Mehdi Denden, Les Rousses (FR); Marco Rochat, Le Brassus (CH)

(73) Assignee: Blancpain SA, Le Brassus (CH)

( * ) Notice: Subject to any disclaimer, the term of this patent is extended or adjusted under 35 U.S.C. 154(b) by 0 days.

(21) Appl. No.: 14/950,355

(22) Filed: Nov. 24, 2015

(65) Prior Publication Data

US 2016/0154378 A1 Jun. 2, 2016

(30) Foreign Application Priority Data

Dec. 2, 2014 (EP) ..... 14195817

(51) Int. Cl.
*G04B 13/00* (2006.01)
*G04B 19/23* (2006.01)
(Continued)

(52) U.S. Cl.
CPC ..... *G04B 13/008* (2013.01); *G04B 19/23* (2013.01); *G04B 19/235* (2013.01);
(Continued)

(58) Field of Classification Search
CPC ..... G04B 13/008; G04B 13/19; G04B 13/22; G04B 19/221; G04B 19/23; G04B 19/235;
(Continued)

(56) References Cited

U.S. PATENT DOCUMENTS 4,443,112 A 4/1984 Stotz et al.
6,847,589 B2 * 1/2005 Wilmouth ..... G04B 19/268 368/16
(Continued)

FOREIGN PATENT DOCUMENTS

| | | |
|---|---|---|
| CH | 674 290 | 5/1990 |
| EP | 1 286 233 A1 | 2/2003 |
| EP | 1 343 056 A1 | 9/2003 |

OTHER PUBLICATIONS

European Search Report issued Sep. 29, 2015 in European Application 14195817, filed on Dec. 2, 2014 (with English translation).

*Primary Examiner* — Vit W Miska
(74) *Attorney, Agent, or Firm* — Oblon, McClelland, Maier & Neustadt, L.L.P.

(57) ABSTRACT

The invention relates to a device for the display of periods which, in succession, form an annual cycle, for a timepiece movement, comprising an indicator member for indicating said periods. It comprises at least a mechanism for controlling the duration of display of said periods including at least:

a drive member for driving the indicator member arranged to drive the indicator member at the moment of a change in period, a cam controlling the duration of display of said periods, and means for driving the cam, a first differential gear with two inputs and one output, a first input being formed by a reference drive wheel, arranged to complete one revolution in one reference period, a second input being formed by an actuation member arranged to cooperate with said cam, and the output being formed by said drive member for the indicator member, said cam comprising a profile arranged such that the actuation member cooperates with the first differential gear to move the drive member for the indicator member forwards
(Continued)

or backwards, depending on the duration of the period displayed relative to the reference period.

11 Claims, 2 Drawing Sheets

(51) Int. Cl.
*G04B 19/25* (2006.01)
*G04B 19/26* (2006.01)
*G04B 19/253* (2006.01)
*G04B 19/22* (2006.01)

(52) U.S. Cl.
CPC ..... *G04B 19/25353* (2013.01); *G04B 19/262* (2013.01); *G04B 19/22* (2013.01)

(58) Field of Classification Search
CPC .. G04B 19/24; G04B 19/25353; G04B 19/26; G04B 19/262
See application file for complete search history.

(56) References Cited

U.S. PATENT DOCUMENTS

2003/0031093 A1* 2/2003 Zaugg ..... G04B 19/23 368/80
2005/0207283 A1 9/2005 Loth
2012/0213037 A1* 8/2012 Schmidt ..... G04B 19/2536 368/37
2014/0126336 A1* 5/2014 Goeller ..... G04B 19/268 368/15
2015/0103635 A1* 4/2015 Rochat ..... G04B 19/23 368/17

* cited by examiner

DEVICE FOR THE DISPLAY OF PERIODS FORMING AN ANNUAL CYCLE

This application claims priority from European patent application No. 14195817.3 filed Dec. 2, 2014, the entire disclosure of which is hereby incorporated herein by reference.

FIELD OF THE INVENTION

The invention relates to a device for the display of periods which, in succession, form an annual cycle, for a timepiece movement, comprising an indicator member for indicating said periods. The present invention also relates to a timepiece including such a display mechanism.

BACKGROUND OF THE INVENTION

An annual cycle may be divided into a certain number of periods, and said periods may include the same number of days or a different number of days. Thus, an annual cycle may be divided into twelve periods corresponding, for example, to the signs of the zodiac. There are twelve of said zodiac signs having a duration of between 29 and 32 days. The change from one sign to the next occurs between the 19th and the 24th of the month and depends on the duration of the sign in question For example, the duration of the sign of Scorpio is 29 days from 24 October to 22 November, whereas the duration of the sign of Cancer is 31 days from 22 June to 22 July. An annual cycle may also be divided into twelve periods corresponding to the twelve months of the year. The duration of said months is between 28 days and 31 days. Devices for the display of such periods are well known to those skilled in the art. They may notably include a disc on which the various periods are depicted by means of angular sectors, the angle of which varies according to the number of days in the period. Such a device is, for example, described in CH Patent Number 698781 for depicting the signs of the zodiac. The current period is displayed by means of an aperture provided in the timepiece dial, or may be indicated by means of an index, such as a hand. Either the disc or the index is driven in rotation to complete one revolution per year. The display is continuous, so the display lacks accuracy when the period is about to change or has just changed, in particular when the display is provided through an aperture. Further, the mechanism driving the period indicator member generally starts from the centre of the movement, such that the period display disc is concentric to the movement, which limits the possible positioning of said period display.

SUMMARY OF THE INVENTION

It is an object of the invention to overcome the various drawbacks of known devices.

More specifically, it is an object of the invention to provide a device for the display of periods of an annual cycle that accurately displays the period, including at the moment of a change in period.

It is also an object of the invention to provide a device for the display of periods of an annual cycle that allows the period display to be positioned independently of the centre of the timepiece in which it is used.

It is also an object of the invention to provide a device for the display of periods of an annual cycle that allows the displayed period to be corrected easily and quickly, if necessary.

To this end, the present invention concerns a mechanical device for the display of periods which, in succession, form an annual cycle, for a timepiece movement, comprising an indicator member for indicating said periods.

According to the invention said display device comprises at least a mechanism for controlling the duration of display of said periods comprising at least:

- a drive member for driving the indicator member arranged to drive the indicator member at the moment of a change in period,
- a cam controlling the duration of display of said periods, and means for driving the cam,
- a first differential gear with two inputs and one output, a first input being formed by reference drive wheel arranged to complete one revolution in one reference period, a second input being formed by an actuation member arranged to cooperate with said cam, and the output being formed by said drive member for the indicator member, said cam comprising a profile arranged such that the actuation member cooperates with the first differential gear to move the drive member for the indicator member, either forwards or backwards, depending on the duration of the period displayed relative to the reference period.

Advantageously, the drive member for the indicator member may include a first drive finger arranged to drive the indicator member at the moment of a change in period.

Advantageously, the cam drive means may include a second drive finger integral with the reference drive wheel and a star integral with the cam, said second drive finger being arranged to cooperate with said star.

Advantageously, the actuation member may be a rack comprising, at one end, a toothed sector forming the second input of the first differential gear, and at another end, a feeler device arranged to cooperate with the cam.

Preferably, the reference drive wheel may be arranged to be in kinematic connection with a wheel of the timepiece movement.

Advantageously, the reference drive wheel may be arranged to complete one revolution in 31 days, so that the reference period is 31 days.

According to a preferred embodiment, the display device may include a correction mechanism for said period display, said correction mechanism including:

- a corrector member,
- a second differential gear with two inputs and one output, a first input arranged to be formed by the wheel of the timepiece movement, a second input formed by said corrector member and the output formed by the reference drive wheel.

According to different variant embodiments, said period indicator member may include a support, on which the periods are depicted in a regular manner, and an index, one of the two being immobile and the other being arranged to be driven by the drive member.

The present invention also concerns a timepiece including a device for the display of periods of an annual cycle as defined above.

Thus, the display device according to the invention includes a jumping display for displaying the periods of an annual cycle with great accuracy, even close to a change in period, with the display jumping at the moment of said change in period. Further, the correction mechanism allows for a simple, quick correction of the period to be displayed, if necessary.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF A PREFERRED EMBODIMENT

The following description is of a device for the display of zodiac signs intended to be used in a timepiece, equipped with a timepiece movement, but which may be adapted by those skilled in the art to a month display.

Figure 1:
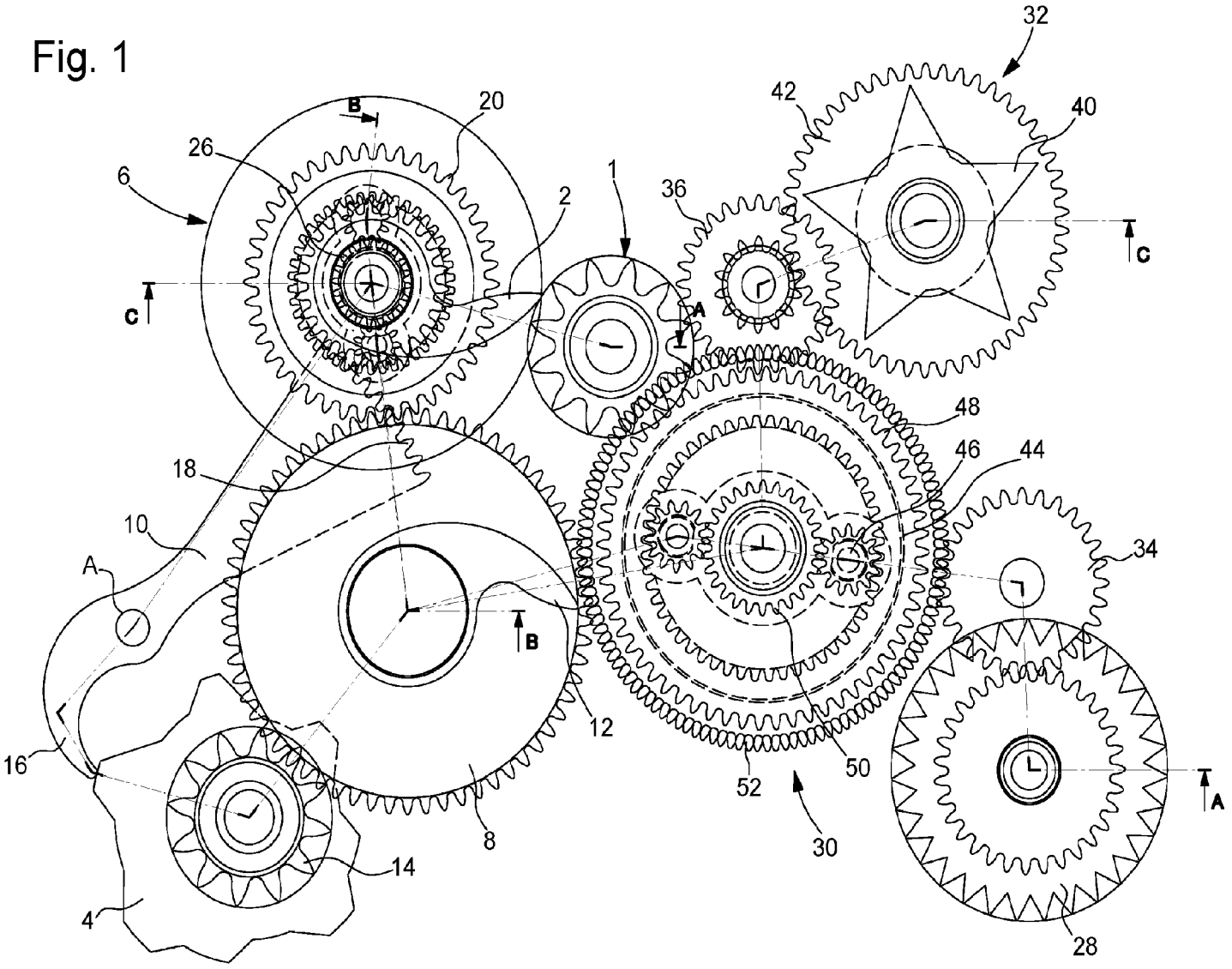
FIG. 1 is a top view of a display device according to the invention.

Referring to FIG. 1, the zodiac sign display device includes a zodiac sign indicator member 1 which includes an index and a support on which the zodiac signs are depicted in a regular manner. "In a regular manner" means that each sign of the zodiac or each period to be displayed occupies the same space on the support, independently of the duration of the sign or of the period. According to a first variant embodiment, the support may be a disc on which the zodiac signs are depicted, in the form of an annular strip, cut into twelve identical areas, distributed in a regular manner around the disc. The disc may be immobile and, in that case, the index may be a rotatably movable hand. The disc may be rotatably movable and, in that case, the index may be an aperture arranged in the timepiece dial for displaying a period. It is also possible to arrange on the dial an opening revealing all or part of the disc, the current period which appears in the opening being indicated by means of an immobile index provided on the dial. In another variant embodiment, the support may take the form of an area marked on the dial, on which the zodiac signs are depicted in a regular manner, and the index is a retrograde hand moving along this area.

According to the invention, the zodiac sign display device includes a mechanism for controlling the duration of said zodiac sign display, including at least:

- a drive member 2 for indicator member 1,
- a cam 4 for controlling the duration of said zodiac sign display,
- a first differential gear 6 with two inputs and one output, a first input being formed by a reference drive wheel 8, arranged to complete one revolution in one reference period, which is 31 days here, a second input being formed by an actuation member 10 arranged to cooperate with said cam 4, and the output being formed by said drive member 2 for indicator member 1.

More specifically, drive member 2 for indicator member 1 is formed by a first drive finger arranged to cause indicator member 1 to jump at the moment of each zodiac sign change.

Cam 4 is mounted to pivot and is driven by drive means comprising a second drive finger 12 integral with reference drive wheel 8 and a 12-tooth star 14 integral with cam 4. Said second drive finger 12 is arranged to cooperate with said star 14 to advance said star 14 one step and to pivot cam 4. Since reference drive wheel 8 completes one revolution in 31 days, second drive finger 12 causes star 14 to jump every 31 days, with cam 4 then also pivoting every 31 days.

Cam 4 is arranged to cooperate with a feeler device 16 arranged at one end of a rack, mounted to pivot at A and forming actuation member 10. The rack includes at the other end thereof a toothed sector 18 forming the second input of first differential gear 6, as will be described below.

Figure 2:
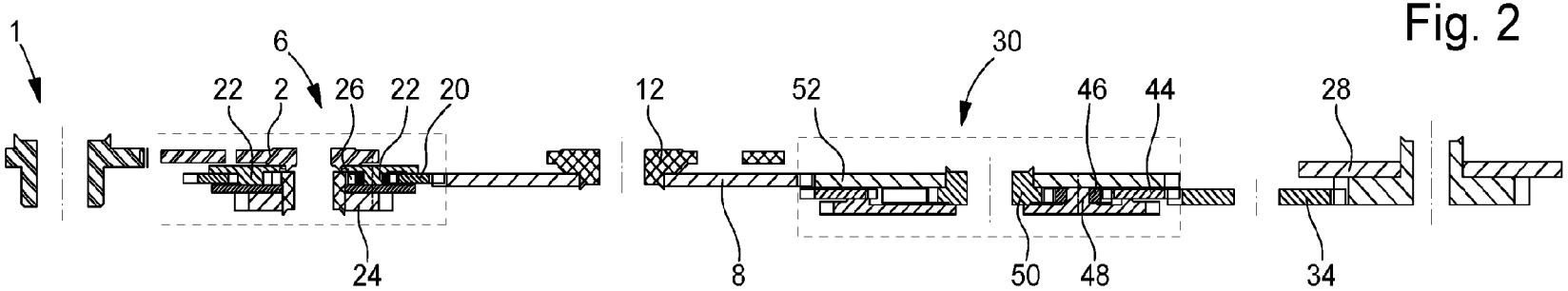
FIG. 2 is a cross-sectional view along line A-A of FIG. 1.
Figure 3:
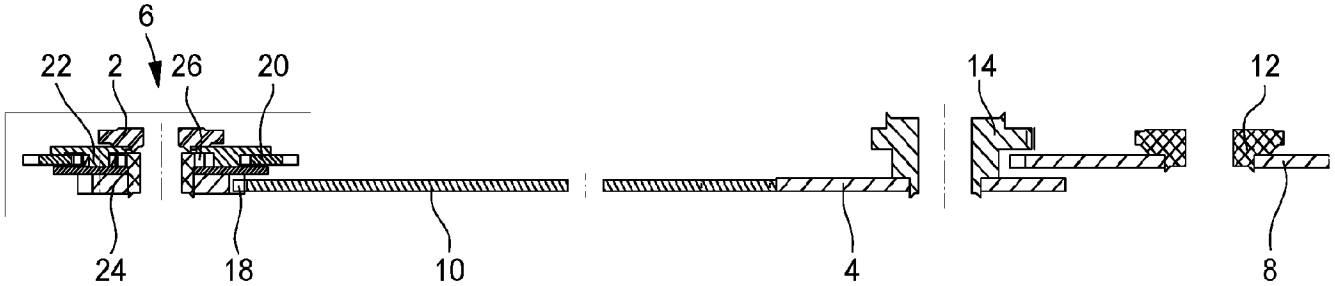
FIG. 3 is a cross-sectional view along line B-B of FIG. 1.

Referring to FIGS. 2 and 3, first differential gear 6 includes a crown 20, which has an outer toothing cooperating with reference drive wheel 8, forming the first input, and an inner toothing cooperating with at least one, and preferably two planetary pinions 22 capable of rotating on themselves and of rolling over said inner toothing. First differential gear 6 also includes a planetary wheel-holder 24 carrying planetary pinions 22, and comprising an outer toothing cooperating with toothed sector 18 of rack 10, forming the second input. First differential gear 6 also includes a pinion 26 placed at the centre of first differential gear 6 and meshing with planetary pinions 22. This pinion 26 is integral with drive member 2 for indicator member 1, forming the output of first differential gear 6.

Cam 4 has a profile arranged such that actuation member 10 cooperates with first differential gear 6 to move drive member 2 for indicator member 1 forwards or backwards depending on the duration of the zodiac sign displayed relative to the 31-day reference period.

Generally, in the timepiece incorporating the display device, there is a mechanism for driving reference drive wheel 8 arranged such that said reference drive wheel 8 completes one revolution in the reference period.

In the variant shown, the drive mechanism for reference drive wheel 8 includes a wheel of the timepiece movement arranged to complete one revolution in 31 days, said drive mechanism for the reference drive wheel being arranged such that the reference drive wheel completes one revolution in 31 days. More specifically, reference drive wheel 8 is arranged to be in kinematic connection with a wheel of the timepiece movement, and more specifically a 31-wheel 28, by means of a second differential gear 30 used, on the one hand, for the kinematic connection between 31-wheel 28 and, on the other hand, as an element of a display correction mechanism.

More specifically, with reference to the Figures, said correction mechanism includes:

- a corrector member 32,
- a second differential gear 30 with two inputs and one output, a first input being formed by 31-wheel 28, via an intermediate wheel 34, a second input being formed by said corrector member 32 via an intermediate wheel 36, and the output being formed by reference drive wheel 8.

The corrector member 32 includes a correction star 40 actuated by a correction control member (not shown) and a correction wheel 42 integral with correction star 40 arranged to mesh with an intermediate pinion 36.

Figure 4:
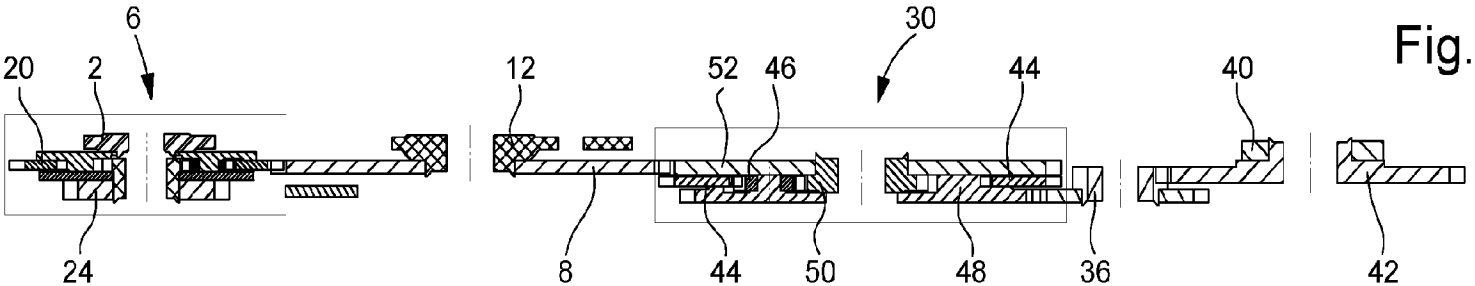
FIG. 4 is a cross-sectional view along line C-C of FIG. 1.

Referring to FIGS. 2 and 4, second differential gear 30 includes a crown 44 which has an outer toothing cooperating with 31-wheel 28 via intermediate wheel 34, forming the first input, and an inner toothing cooperating with at least one, and preferably two planetary pinions 46 capable of rotating on themselves and of rolling over said inner toothing. Second differential gear 30 also includes a planetary wheel-holder 48 carrying planetary pinions 46 and comprising an outer toothing cooperating with correction wheel 42 via intermediate wheel 36, forming the second input. Second differential gear 30 also includes a pinion 50 placed at the centre of second differential gear 30 and meshing with planetary pinions 46. This pinion 50 is integral with a wheel 52 meshing with reference drive wheel 8 forming the output of second differential gear 30.

It is clear that the display device of the present invention can be used independently of the correction mechanism. In such case, reference drive wheel 8 can be driven by a wheel arranged in the timepiece movement and moved at a suitable speed, without using the second differential gear.

The operation of the display device of the invention is as follows: in normal timepiece operation mode, the 31-wheel 28 drives crown 44 (first input of second differential gear 30) via intermediate wheel 34. The correction mechanism is not actuated, thus planetary-holder 48 is immobile and planetary pinions 46 do not move. Crown 44 rotates said planetary pinions 46 on themselves which in turn causes the rotation of pinion 50, and thus of wheel 52 (the output of second differential gear 30). Said wheel 52 drives reference drive wheel 8 and thus second drive finger 12. The wheel dimensions and number of teeth are adapted so that reference drive wheel 8 completes one revolution in 31 days.

Reference drive wheel 8 drives crown 20 (the first input of first differential gear 6). Cam 4 and rack 10 are immobile, therefore planetary-holder 24 is immobile and planetary pinions 22 do not move. Crown 20 rotates said planetary pinions 22 on themselves, which in turn causes the rotation of pinion 26, and thus of first drive finger 2 (the output of first differential gear 6) which, when it reaches a position facing said indicator member 1 will cause said indicator member to jump and change to the display of the next zodiac sign. In order for the change in zodiac sign to occur on the correct date, and in order to observe the duration of display of the current sign, second drive finger 12 causes star 14 to jump at each revolution of reference drive wheel 8, namely every 31 days. Cam 4 pivots at each jump of star 14. Feeler device 16, which is in contact with cam 4, pivots rack 10 through an angle corresponding to the profile of cam 4. In pivoting, said rack 10 (the second input of first differential gear 6) drives planetary wheel-holder 24 and thus planetary pinions 22. They roll over the inner toothing of crown 20 and rotate on themselves, driving in turn pinion 26, and thus first drive finger 2 through a certain angle, in order to adjust the position of said first drive finger 2 by moving it forwards or backwards relative to the duration of the current zodiac period, which may vary from 29 to 32 days. Thus, the correctly repositioned first drive finger 2 will automatically make indicator member 1 jump at the exact moment of the zodiac sign change, so that there is no uncertainty as to the current zodiac period displayed.

If it is necessary to correct the zodiac sign displayed, the user actuates the correction control member which drives correction star 40 and thus correction wheel 42 (the second input of second differential gear 30). The latter drives planetary-holder 48, and thus planetary pinions 46, via intermediate wheel 36. They roll over the inner toothing of crown 44 and rotate on themselves, driving in turn pinion 50, and thus wheel 52. Said wheel 52 drives in turn reference drive wheel 8, so that the latter makes one complete revolution thereby allowing for a simple, quick correction of the displayed zodiac period, independently of timepiece movement wheel 28.

Further, the display device of the invention makes it possible for the indicator member to be positioned off-centre relative to the centre of the movement, so that numerous variant embodiments are possible.

Of course, the present invention is not limited to the illustrated example and is capable of various variants and modifications that will be evident to those skilled in the art. In particular, the display device described for displaying zodiac signs may be adapted to a month display.

What is claimed is:

1. A device for the display of periods which, in succession, form an annual cycle, for a timepiece movement, comprising an indicator member for indicating said periods, wherein the device comprises at least a mechanism for controlling the duration of display of said periods by said indicator member comprising at least:

a drive member for driving the indicator member arranged to drive the indicator member at the moment of a change in period, a cam controlling the duration of display of said periods, and means for driving the cam, a first differential gear with two inputs and one output, a first input being formed by a reference drive wheel, arranged to complete one revolution in one reference period, a second input being formed by an actuation member arranged to cooperate with said cam, and the output being formed by said drive member for the indicator member, said cam comprising a profile arranged such that the actuation member cooperates with the first differential gear to move the drive member for the indicator member forwards or backwards, depending on the duration of the period displayed by the indicator member relative to the reference period.

2. The display device according to claim 1, wherein the drive member for the indicator member comprises a first drive finger arranged to drive the indicator member at the moment of a change in period.

3. The display device according to claim 1, wherein the cam drive means comprise a second drive finger integral with the reference drive wheel and a star integral with the cam, said second drive finger being arranged to cooperate with said star.

4. The display device according to claim 1, wherein the actuation member is a rack comprising, at one end, a toothed sector forming the second input of the first differential gear, and at another end, a feeler device arranged to cooperate with the cam.

5. The display device according to claim 4, wherein the reference drive wheel is arranged to be in kinematic connection with a wheel of the timepiece movement.

6. The display device according to claim 5, wherein the reference drive wheel is arranged to complete one revolution in 31 days, so that the reference period is 31 days.

7. The display device according to claim 5, wherein the device comprises a correction mechanism for correcting the display of said periods, said correction mechanism including:

a corrector member, a second differential gear with two inputs and one output, a first input arranged to be formed by the wheel of the timepiece movement, a second input being formed by said corrector member and the output being formed by the reference drive wheel.

8. The display device according to claim 1, wherein said period indicator member comprises a support on which the periods are depicted in a regular manner, and an index, one being immobile and the other being arranged to be driven by the drive member.

9. A timepiece comprising a device for the display of periods which, in succession, form an annular cycle according to claim 1.

10. The timepiece according to claim 9, wherein the timepiece includes a mechanism for driving the reference drive wheel arranged such that said reference drive wheel completes one revolution in the reference period.

11. The timepiece according to claim 10, wherein the drive mechanism for the reference drive wheel comprises a wheel of the timepiece movement arranged to complete one revolution in 31 days, said drive mechanism for the reference drive wheel being arranged such that the reference drive wheel completes one revolution in 31 days.

* * * * *